US012465134B2

(12) United States Patent
Kevan

(10) Patent No.: US 12,465,134 B2
(45) Date of Patent: Nov. 11, 2025

(54) APPARATUS FOR STABILIZING THE CORE OF A PERSON

(71) Applicant: Amelia Kevan, Saint Paul, MN (US)

(72) Inventor: Amelia Kevan, Saint Paul, MN (US)

( * ) Notice: Subject to any disclaimer, the term of this patent is extended or adjusted under 35 U.S.C. 154(b) by 338 days.

(21) Appl. No.: 18/128,771

(22) Filed: Mar. 30, 2023

(65) Prior Publication Data

US 2024/0324757 A1 Oct. 3, 2024

(51) Int. Cl.

| | |
|---|---|
| ***A45F 3/14*** | (2006.01) |
| ***A63B 21/00*** | (2006.01) |
| ***A63B 23/02*** | (2006.01) |

(52) U.S. Cl.

CPC ..... *A45F 3/14* (2013.01); *A63B 21/4039* (2015.10); *A63B 23/0205* (2013.01); *A45F 2003/146* (2013.01)

(58) Field of Classification Search

CPC .... A45F 3/14; A63B 21/4039; A63B 23/0205
See application file for complete search history.

(56) References Cited

U.S. PATENT DOCUMENTS

D238,725 S * 2/1976 Zerobnick et al. ..... D3/226
4,029,243 A * 6/1977 Zerobnick ..... A45F 3/00 224/664
4,523,703 A * 6/1985 McKenna ..... A45F 3/00 224/660
5,025,965 A * 6/1991 Smith ..... A45F 3/04 224/660
5,205,448 A * 4/1993 Kester ..... A45C 11/38 224/901.2
5,397,040 A * 3/1995 Lee ..... A01K 97/06 224/240
5,450,991 A * 9/1995 Neading ..... A45F 3/14 294/157
5,570,824 A * 11/1996 Lyon ..... A45F 5/021 224/678
5,702,042 A * 12/1997 Peacock ..... A45F 3/00 224/660
5,725,139 A * 3/1998 Smith ..... A45F 3/02 224/637
6,099,490 A * 8/2000 Turtzo ..... A61F 5/028 2/311
6,109,496 A * 8/2000 Andrew ..... A45F 3/00 224/660
6,145,721 A * 11/2000 Gately ..... A45C 13/40 224/660
6,293,445 B1 * 9/2001 Miller ..... A45F 5/021 224/679
6,364,186 B1 4/2002 Gilmour et al.
(Continued)

*Primary Examiner* — Brian D Nash
(74) *Attorney, Agent, or Firm* — Edlavitch Law PLLC

(57) ABSTRACT

Disclosed herein are apparatuses for strengthening or stabilizing the glutes, the abdominal muscles, or the core of a person wearing one of the apparatuses. In some embodiments, an apparatus includes a bag that can rest near or on the glutes, stabilized by a front harness that activates, strengthens, or stabilizes the abdominal muscles. The apparatus includes straps that wrap around the hips and connect the front harness to the bag. For example, two pairs of straps can connect the bag to the harness, and one pair can wrap at the top or just above the hips and the other pair can wrap at the bottom or just below the hips.

20 Claims, 6 Drawing Sheets

(56) References Cited

U.S. PATENT DOCUMENTS 6,971,562 B2 * 12/2005 Willows ..... A45F 3/16 224/148.7
7,316,660 B1 * 1/2008 Modglin ..... A61F 5/028 602/5
7,437,789 B2 10/2008 Thompson
7,979,919 B2 7/2011 Joran
8,528,866 B2 * 9/2013 Fradet ..... B64D 17/30 244/148
8,795,215 B2 * 8/2014 Rossi ..... A61F 5/026 602/5
9,420,832 B2 * 8/2016 Arnold ..... A61G 7/1051
9,756,920 B2 * 9/2017 Spears ..... A45F 3/047
9,801,451 B2 * 10/2017 Murdoch ..... A45F 3/005
9,901,160 B2 * 2/2018 Donato, Jr. ..... A45F 5/021
10,799,409 B2 * 10/2020 Rydstrom ..... A61G 7/1051
11,571,323 B2 * 2/2023 Ingimundarson ..... A61F 5/022
11,576,479 B2 * 2/2023 Mozafari ..... A45F 3/005
12,178,745 B1 * 12/2024 Brookins ..... A61F 7/02
2010/0094386 A1 * 4/2010 Margolis ..... A61F 7/00 607/108
2010/0168630 A1 * 7/2010 Cropper ..... A61F 5/024 602/19
2010/0318010 A1 * 12/2010 Sandifer ..... A61F 5/026 602/19
2011/0247127 A1 10/2011 Pou et al.
2014/0076940 A1 * 3/2014 Sprague ..... A45F 3/00 224/148.5
2020/0103073 A1 * 4/2020 Lennings ..... A45F 3/08
2020/0305581 A1 * 10/2020 Barklow ..... A41D 13/0007
2023/0131059 A1 * 4/2023 Mast ..... B65G 7/12 224/270
2024/0049845 A1 * 2/2024 Munie ..... A45F 3/047
2025/0017337 A1 * 1/2025 Bailey ..... A45C 11/008

* cited by examiner

APPARATUS FOR STABILIZING THE CORE OF A PERSON

TECHNICAL FIELD

The present disclosure relates to apparatuses for stabilizing the glutes, abdominal muscles, or the core of a person.

BACKGROUND

The abdominal muscles hold organs in place and support the body during movement. The core muscles (or the core) include muscles of the pelvis, lower back, hips, and stomach generally. Apparatuses have been developed to strengthen and stabilize the abdominal muscles and other muscles of the core and there continue to be improvements to such apparatuses and problems to be solved in the field.

SUMMARY

Disclosed herein are apparatuses for strengthening or stabilizing the glutes, the abdominal muscles, or the core of a person wearing one of the apparatuses. In some embodiments, an apparatus includes a bag that can rest near or on the glutes of a person, stabilized by a front harness that activates, strengthens, or stabilizes the abdominal muscles of the person. The apparatus includes at least two pairs of straps (an upper pair and a lower pair) that wrap around the hips and connect the front harness to the bag. For example, two pairs of straps can connect the bag to the harness and one pair of the two pairs can wrap at the top or just above the hips of the person wearing the apparatus and the other pair of the two pairs can wrap at the bottom or just below the hips. In some embodiments, the front harness includes a connecting latch and a release button, per strap, configured to provide easy placement and removal of the apparatus from a person. The front harness can include respective housings that house the latches.

These and other important aspects of the invention are described more fully in the detailed description below. The invention is not limited to the particular assemblies, apparatuses, methods, and systems disclosed herein. Other embodiments can be used and changes to the described embodiments can be made without departing from the scope of the claims that follow the detailed description.

BRIEF DESCRIPTION OF THE DRAWINGS

The present disclosure will be understood more fully from the detailed description given below and from the accompanying drawings of various example embodiments of the disclosure.

DETAILED DESCRIPTION

Figure 1B:
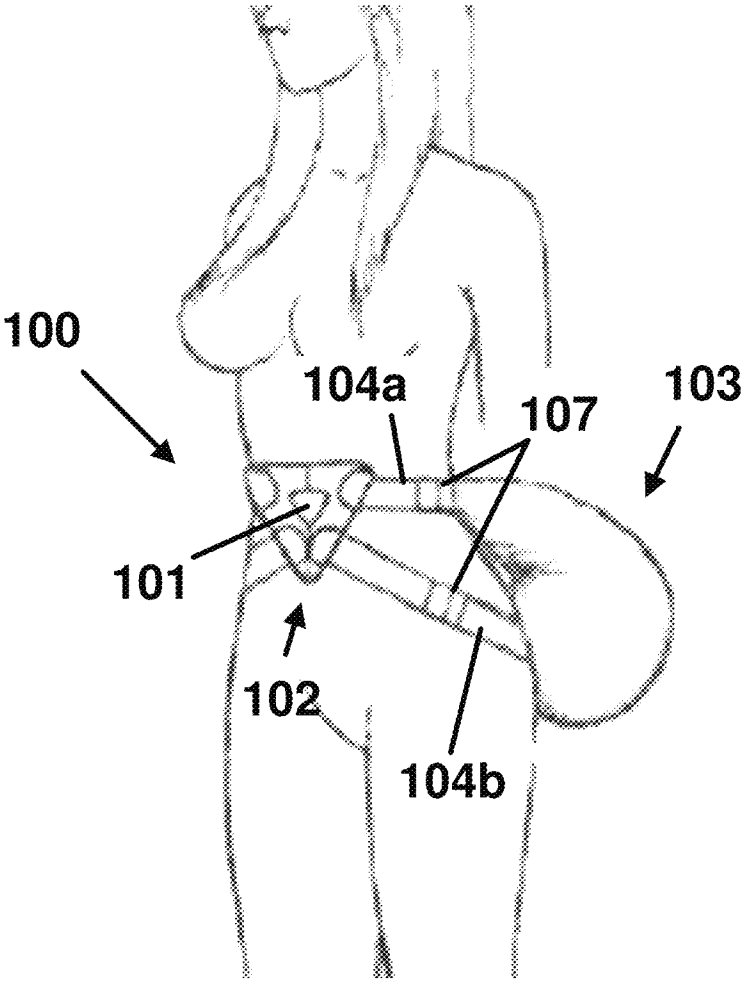
FIGS. 1A, 1B, 1C, 1D, and 1E illustrate different perspective views of an example apparatus while it is being worn by a person, in accordance with some embodiments of the present disclosure.
Figure 1A:
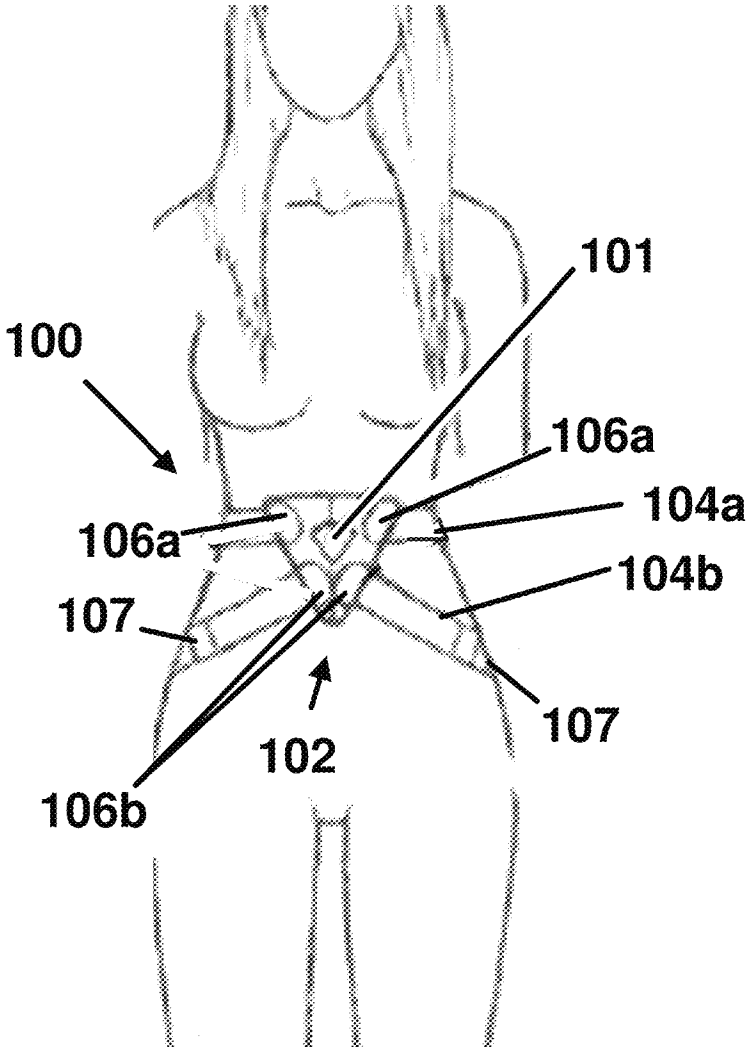
Figures 1C, 1D, 1E:
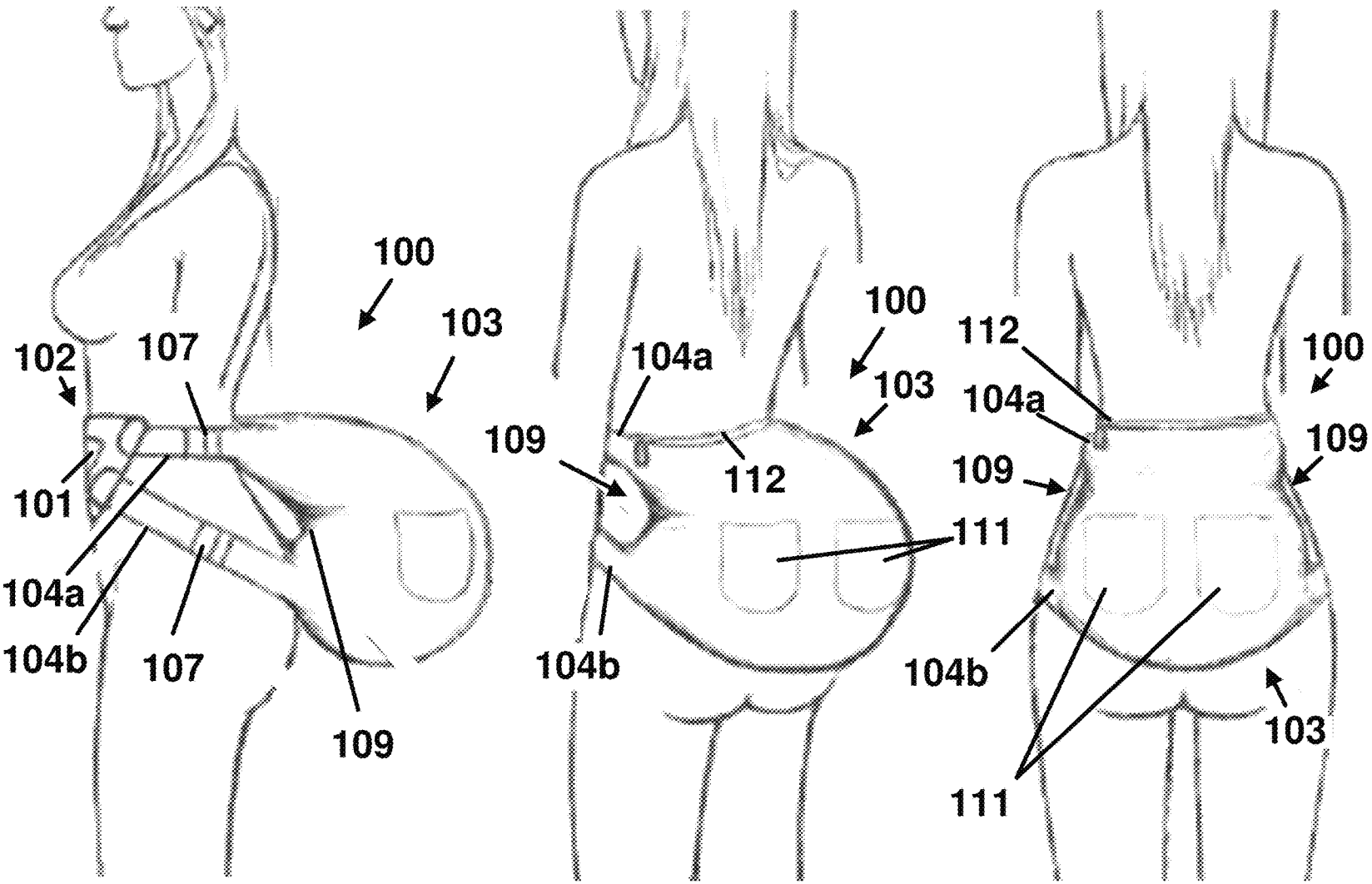
Figure 2B:
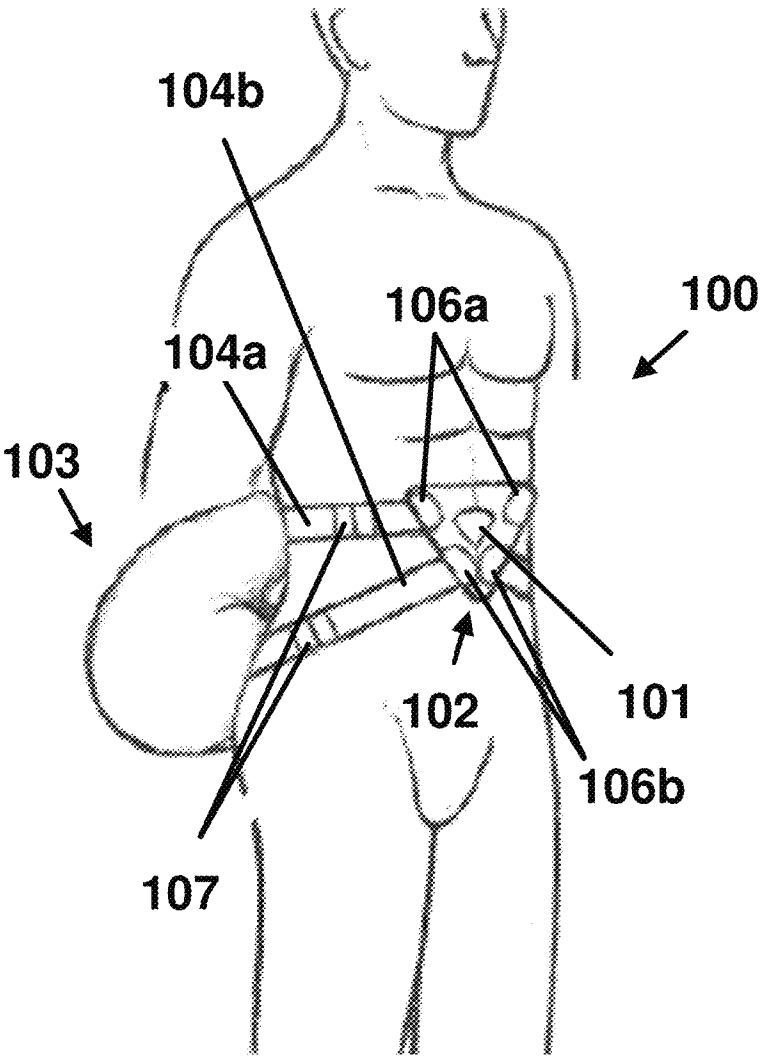
FIGS. 2A, 2B, 2C, 2D, and 2E illustrate different perspective views of the apparatus while it is being worn by a person, in accordance with some embodiments of the present disclosure.
Figure 2A:
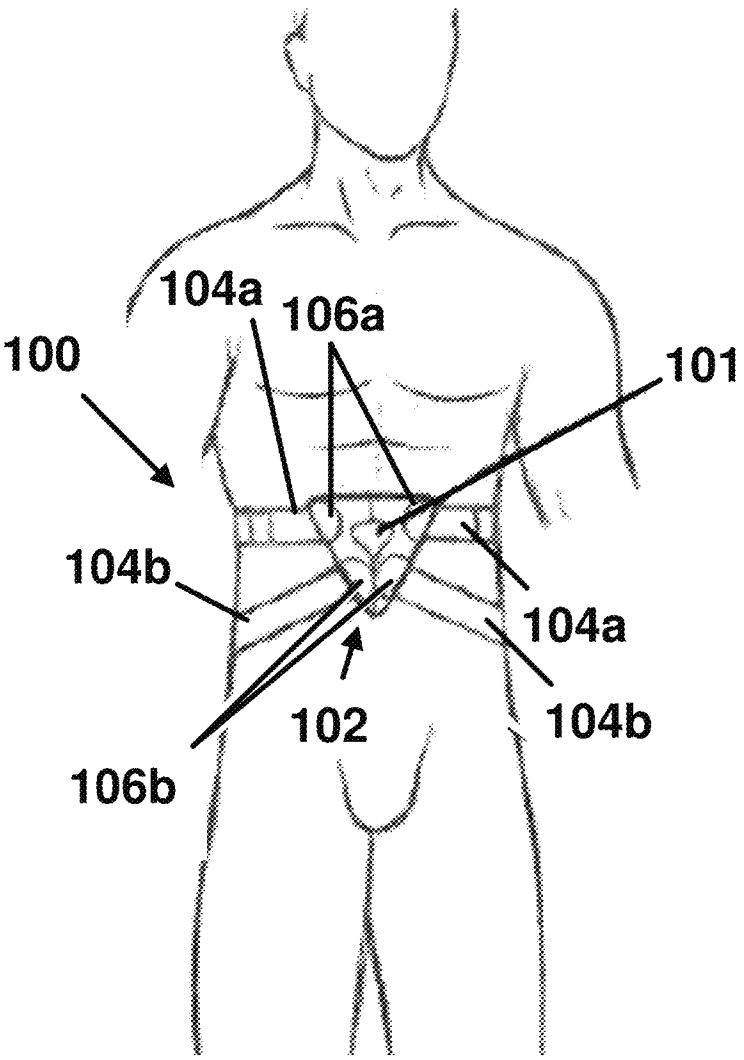
Figures 2C, 2D, 2E:
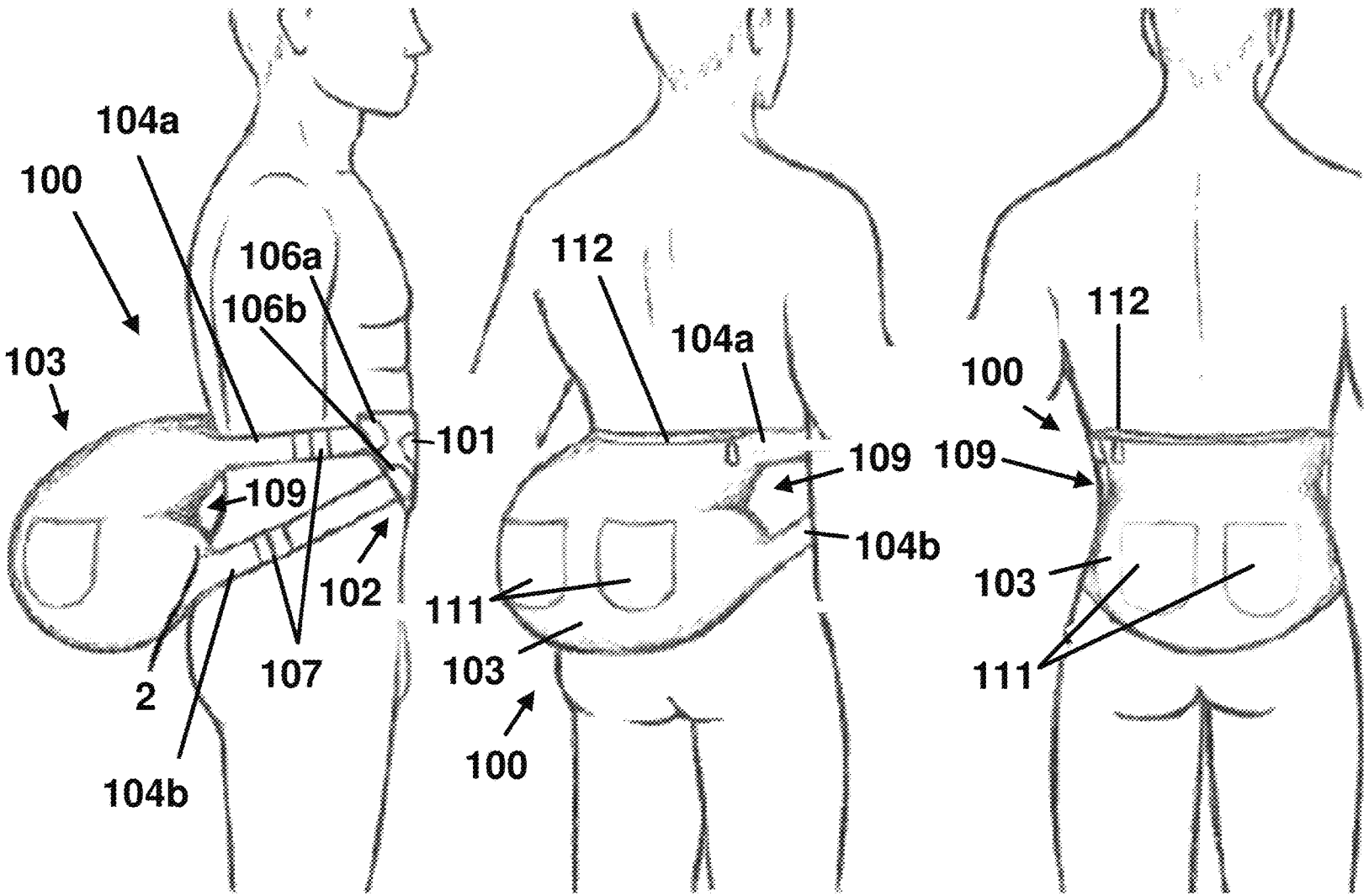

The present disclosure will be understood more fully from the detailed description given below and from the accompanying drawings of various example embodiments of the disclosure.

Disclosed herein are apparatuses for strengthening or stabilizing the glutes or the abdominal muscles of a person wearing one of the apparatuses. In some embodiments, an apparatus includes a bag that can rest near or on the glutes of a person, stabilized by a front harness that activates, strengthens, or stabilizes the abdominal muscles of the person (e.g., see apparatus 100 shown in the drawings). The apparatus includes at least two pairs of straps (an upper pair and a lower pair) that wrap around the hips and connect the front harness to the bag. For example, two pairs of straps can connect the bag to the harness and one pair of the two pairs can wrap at the top or just above the hips of the person wearing the apparatus and the other pair of the two pairs can wrap at the bottom or just below the hips (e.g., see upper straps 104*a* and upper straps 104*b* shown in the drawings). In some embodiments, the front harness includes a connecting latch and a release button, per strap, configured to provide easy placement and removal of the apparatus from a person. The front harness can include respective housings that house the latches. E.g., see the upper strap connectors 106*a* and lower strap connectors 106*b* shown in the drawings.

Some examples of the apparatus can be used by a person for exercising, hiking, hunting, or any activity where a utility bag is needed. Unlike most backpacks, some embodiments of the apparatus can help with posture by pulling the spine upright, strengthening the lower torso, relieving shoulders and neck of strain, freeing the upper body, and balancing the lower body. Some embodiments can be used as a bag for carrying objects (such as weights for strength training). In some examples, the bag can also assist carrying objects longer than the bag that can be placed between a back curve of the bag and the body of a person. Also, in some embodiments, the apparatus is configured to carry small children (such as on a top portion of a hump of the apparatus in some examples).

Figure 3:
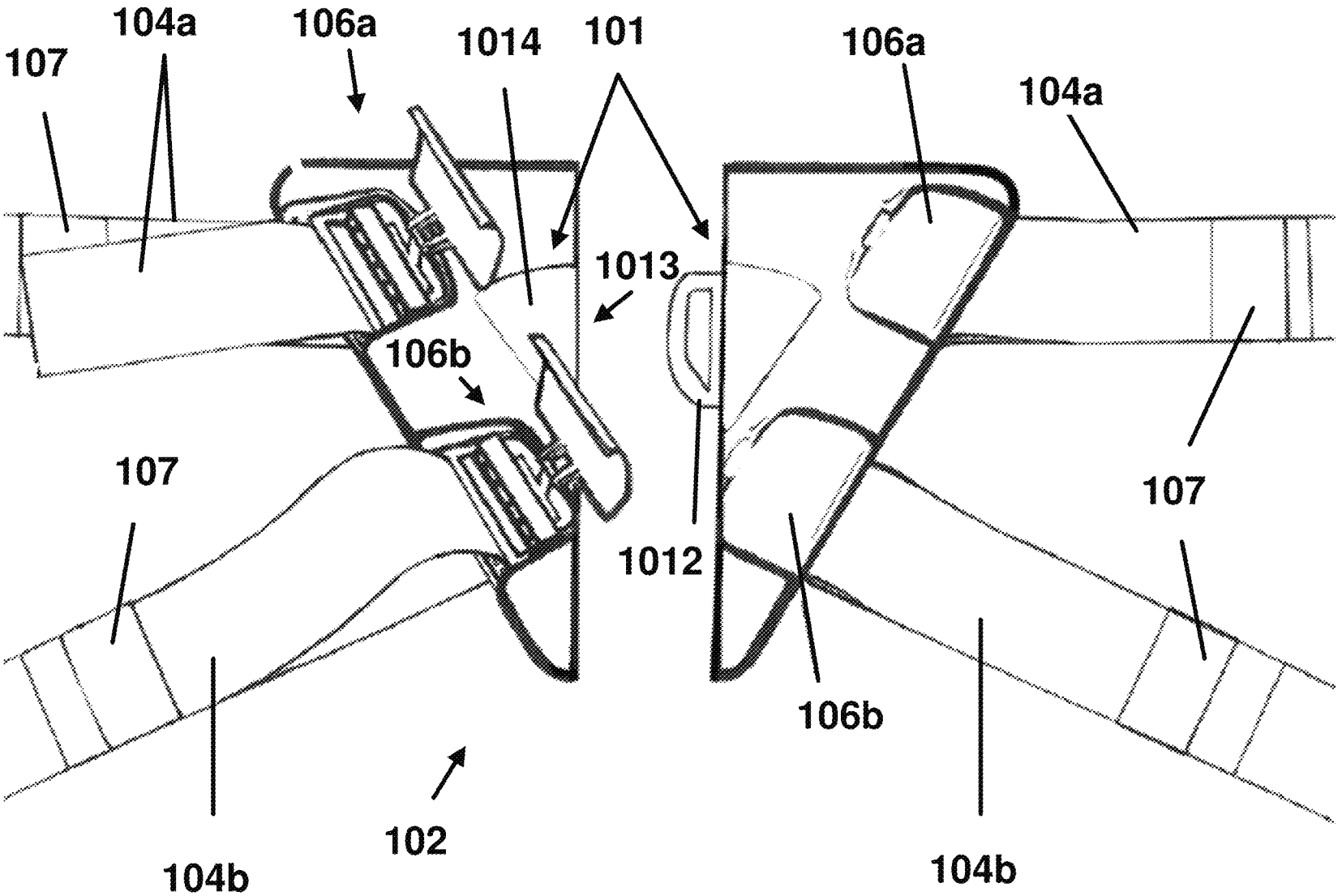
FIG. 3 illustrates a perspective view of a buckle of the apparatus shown in FIGS. 1A to 1E and 2A to 2E, in accordance with some embodiments of the present disclosure.

FIGS. 1A to 1E illustrate different perspective views of an example apparatus 100 while it is being worn by a person. Also, FIGS. 2A to 2E and FIGS. 4A to 4C illustrate different perspective views of the apparatus 100 while it is being worn by a person. FIG. 3 shows a perspective view of parts of the buckle 101 of the harness 102 of the apparatus 100. In the FIGS. 1A to 1E, 2A to 2E, 3, and 4A to 4C, some portions or parts of the person or the apparatus 100 are broken away or removed or not depicted for the sake of illustrating examples aspects of the apparatus 10 concisely.

As shown, the apparatus 100 includes a harness 102 and the buckle 101 is integrated as a part of the harness. The apparatus 100 also includes a bag 103 and upper straps 104*a* and lower straps 104*b* connecting the bag to the harness 102. Also shown, the bag 103 includes back pockets 111 arranged to appear as two back pockets of pants. Also, the bag 103 includes a top zipper 112 that is configured to open and close a top opening of the bag. Not depicted, the top opening (closable by the zipper 112) provides an opening to a compartment within the bag 103.

The upper straps 104*a* and the lower straps 104*b* are attached to the harness 102 by way of corresponding upper strap connectors 106*a* and lower strap connectors 106*b*. In some embodiments, the upper strap connectors 106*a* and the lower strap connectors 106*b* include respective open ratchet-like clips for adjustment and securement of straps. The upper straps 104*a* and the lower straps 104*b* are attached to bag 103, such as by being sewn to the bag in some embodiments. As shown, in some embodiments, with the upper straps 104*a* and the lower straps 104*b*, each strap includes an intra-strap connector 107 configured to connect opposing portions 108*a* and 108*b* of the strap. Each intra-strap connector 107 is also configured to disconnect the opposing portions 108*a* and 108*b* of the strap when a release part (such as a release button or lever) is pressed or pulled depending on the embodiment. In some embodiments, the intra-strap connector 107 includes an open ratchet-like clip for adjustment and securement of the strap.

As shown the apparatus 100 includes a bag arch 109 at a back side of the bag 103. The bag arch 109 provides an opening and a space between the bag 103 and the person wearing the bag.

As shown in FIG. 3, the buckle 101 includes a male part 1012 and a female part 1013, and the buckle attaches the two halves of the harness 102 when the male part 1012 is inserted into the female part 1013. Not shown is a locking mechanism within the female part 1013 that locks the male part 1012 to the female part. In some embodiments, the buckle can be disconnected by a release button (e.g., see release button 1014, which is shown as being integrated with the buckle 101 and specifically integrated with the female part 1013 of the buckle). In some embodiments, the buckle 101 includes a metal latch for locking one half of the harness 102 to the other half of the harness. As shown, the harness is made of up two halves, in that each of the two haves is symmetrical with respect to the other. In some other embodiments, the two parts of the harness are asymmetrical with respect to each other and not halves of the harness but two separated parts with different dimensions. In some embodiments, the buckle or the harness includes an insert and release button for the metal latch. The metal latch can be a metal harness locking latch in some examples.

FIG. 3 also shows that the harness 102 is triangular and the buckle 101 is also triangular. In some embodiments, the shape of the harness and the buckle are the same. And, in some embodiments, the two halves of the harness 102 are similar in shape to the corresponding halves of the buckle 101. FIG. 3 also shows the closed ratchet like strap clip that locks the strap in at the connectors 106*a* and 106*b*. Also shown, the connectors 106*a* and 106*b* include respective strap clips for holding in left-over strap portions. In some embodiments, the buckle 101 includes extra-strap inserts and holders to hold extra-portions of the straps so they are contained within the buckle 101 or the harness 102.

Figures 4A, 4B, 4C:
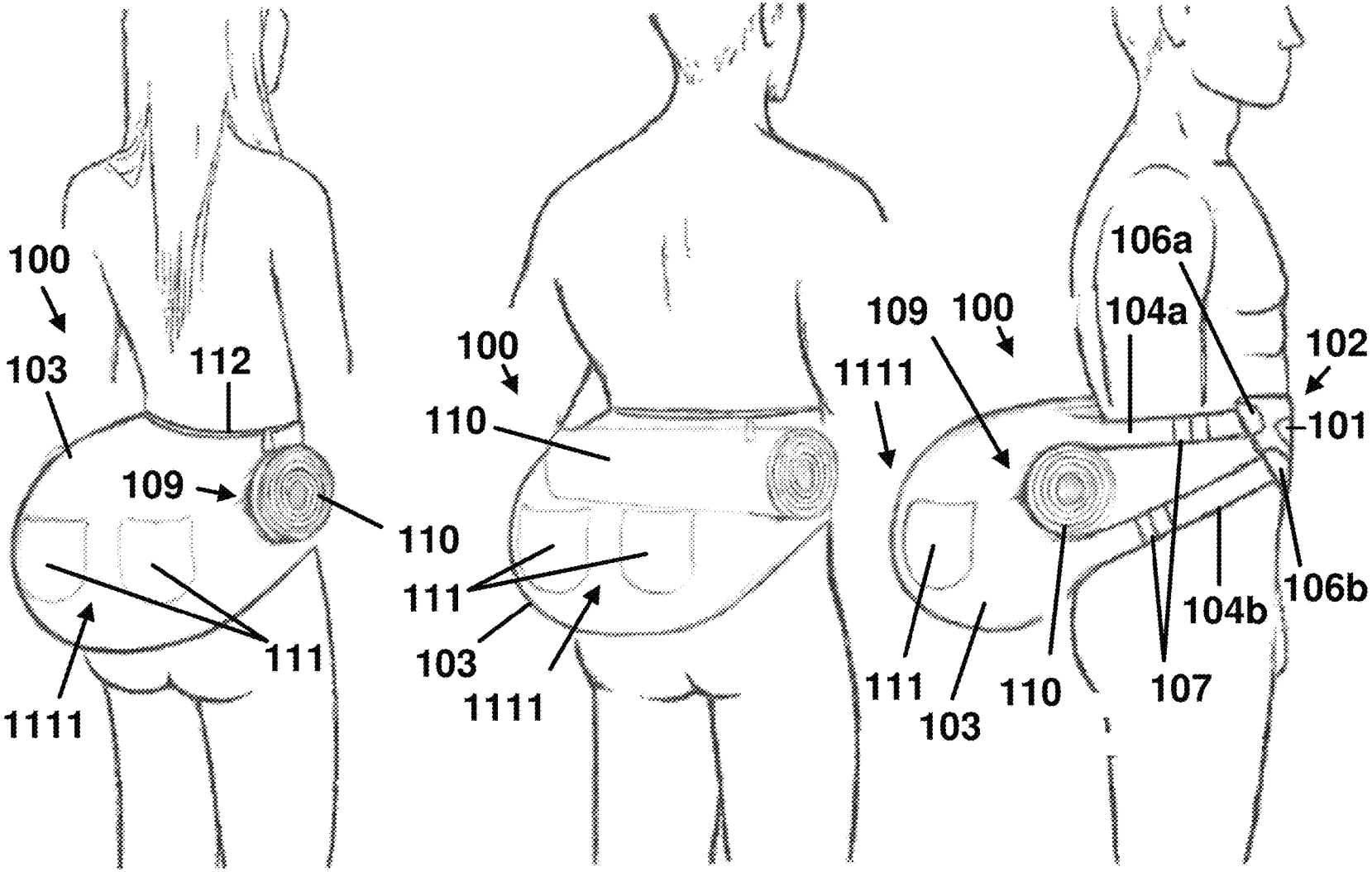
FIGS. 4A, 4B, and 4C illustrate different perspective views of an example apparatus while it is being worn by a person and a rolled yoga mat is inserted between a portion of the apparatus and the person, in accordance with some embodiments of the present disclosure.

As depicted in FIG. 4B, the bag arch 109 is partially removed to show a rolled yoga mat 110 inserted into the space between the bag 103 and the person wearing the bag the is provided by the bag arch. Also, FIG. 4B as well as some of the other figures show the back pockets 111 are attached to the back of the bag 103 at an opposing side of the bag from the bag arch 109. The opposing side of the bag includes a back arch 1111 and the back pockets 111 are positioned at the back arch. Also shown, the bag arch 109 can be used for carrying long objects when bag is placed on a person's body (e.g., see yoga mat 110).

The apparatus 100 was developed as a bag to release pressure from the upper body, help with posture, stimulate the core of the body, help with balance, and strengthen the lower body, while relieving the upper body from unnecessary pressure and strain. The front of the apparatus 100 and its harness 102 can sit directly over the abdominal area of a person and the bag 103 of the apparatus can sit on the backside of the person directly on the glutes. With the use of the apparatus both the abdominal muscles and the glutes are stimulated and in some cases activated. When the apparatus is sitting in its wearable position, it pulls the spine up straight, improving posture of whomever is wearing it.

In some examples, the apparatus 100 is available in two sizes, one for exercise and one for use as a general-purpose bag or sack. The apparatus 100 fastens around a person in the front of the person, over the abdominal area. In some embodiments, the apparatus 100 is held in place by a thick foam piece ads cushion and support for attaching the apparatus to a person. In some examples, within the foam is a latch that will snap the harness 102 together, and with a release button (e.g., see release button 1014) the harness 102 provides for easy removal of the apparatus 100. The foam front, which can be a part of the harness 102, can house the four adjustment latches (e.g., see connectors 106*a* and 106*b*) for the four straps that hold the bag in place over the glutes (e.g., see straps 104*a* and 104*b*). In some examples, each adjustment latch has its own latch for easy placement and removal of the strap from the harness 102. Once in place on a person, the bag 103 of the apparatus will sit directly over the glutes, and the apparatus will be held in place by the core of a person, comfortably leaving the hands free.

The bag 103 of the apparatus 100 can be used for carrying things inside the bag. The outer pockets (e.g., see pockets 111) can hold weights to add more weight to the apparatus 100 to provide balance to the apparatus and greater resistance to a person using the apparatus for exercise. And, as shown, the bag 103 of the apparatus 100 can assist the apparatus in carrying long objects (such as objects longer than the width of the bag, e.g., a fishing pole, yoga mat, walking sticks, etc.). The long object can be placed in between the upper and lower straps of bag, the arch of the bag and the body of the person wearing the apparatus. Also, in some embodiments, the bag 103 is large enough to comfortably carry small children on top of the bag with little pressure on the back.

In some embodiments, the harness 102 includes or is made up of foam and is triangular in shape. The harness 102, which is in the front of the apparatus 100, includes two sides connected to each other and to two sides of the bag 103 by two straps on each part of the harness 102 (which is a two-part harness). E.g., see the pair of upper and lower straps 104*a* and 104*b* included with apparatus 100, in which one of the pairs attaches to one of the two parts of the harness 102 and the other one of the pair of straps attaches to the other one of the two parts of the harness. The pair of straps 104*a* and 104*b* are adjustable straps that slide through a ratchet-style clip, connected to the front harness 102 (e.g., see connectors 106*a* and 106*b*). The harness 102 includes four ratchet-style clips within the connectors 106*a* and 106*b* for the four straps of the apparatus (two connectors and two straps for each vertical side or horizontal size of the harness). The extra strap length can be placed into an extra strap holder that keeps the strap in place (e.g., respective holders can be a part of respective parts of the buckle 101, the harness 102, or the connectors 106*a* and 106*b*).

The harness 102 can be placed over the abdominal muscles as shown. The two sides of the harness 102 can be buckled together by a metal hook that can be easily released by a release button placed on the front of the harness (e.g., see buckle 101). Once the harness 102 is fitted on the abdominal area, the straps 104*a* and 104*b* are easily adjusted by releasing one or more of the clips within the connectors 106*a* and 106*b* of the harness or within the intra-strap connectors 107. The adjustments can be done by pulling the straps to a length that leaves the apparatus secured to the body of the person, and then by closing the clips to lock the straps into place.

The bag 103 is connected to the front harness by thick straps, and in some embodiments, the straps have a thickness that is greater than two millimeters. The bag 103 rests on the gluteus muscles and the straps 104*a* and 104*b* lay on or around the hips of a person. The bag 103 can be used with added weight for exercise by adding weights within the container securable by the zipper 112 or within the pockets 111. Or, the container within the bag 103 can be used as a compartment of a general carrying bag. The bag 103 is adjustable to place weight on either your gluteus maximus or your gluteus Medius. The bag can also be used to carry young children. When adjusted the bag 103 folds allowing long items to be placed through a space between the waist of the person and the bag (e.g., see the yoga mat 110).

The bag 103 opens at the top with a zipping mechanism (e.g., see zipper 112). There are pockets within the container of the bag (not depicted) that allow for attaching even further weight or using such pockets to enhance its use as a general carrying bag. In some embodiments, the apparatus can include the weights to add to the bag 103. In such examples, the weights can further stimulate or activate the glutes and the abdominal muscles to exercise the core of the person wearing the apparatus 100. The balance between the bag 103 and the harness 102 pulls the spine of a user upright into good posture while activating both the glutes and the abdominal muscles.

In some embodiments, the straps 104*a* and 104*b* are heavy-duty industrial grade straps (e.g., straps with a thickness greater than two millimeters). In some embodiments, there are four or more straps, and each of four corners of the bag 103 is attached to at least one of the straps. In general, the straps 104*a* and 104*b* connect to both sides of the harness 102. When the harness 102 is buckled in the front of a user, via the buckle 101, there are two straps on either side of the body of the user. In some examples, the upper straps 104*a* are arranged on the apparatus 100 to sit above the hips of a user wearing the apparatus properly. And, the lower straps 104*b* are positioned across the hips ending at the back which can be placed either on the gluteus medius or the gluteus maximus, when the person is wearing the apparatus properly.

The straps are adjusted or released to release or loosen the apparatus 100 from the person by releasing one or more rachet-like clips of the harness 102, which are part of the connectors 106*a* and 106*b*. And, a user can either pull parts of the strap to increase or relieve tension of the strap on the person wearing the apparatus. Once a user adjusts the straps, the positioning of the straps can be fixed by lockable clips within the connectors 106 or the connectors 107. And, in some embodiments, extra strap beyond the strap securing the apparatus 100 to the person can be held by a housing of the connectors 106 or the connectors 107. In some embodiments, ratchet-style clips can hold and release the straps to different lengths or positions. And, such clips or other types of clips can be located on the front of the front harness or on the front or front-side of the connectors 106 or the connectors 107. For example, there can be four separate clips on the harness 102 within the four separate connectors 106, and there can be four separate clips in the four separate intra-strap connectors 107 (as shown in the drawings to some extent).

The buckle 101 of the harness 102 attaches the two main parts of the harness (or the two symmetrical halves of the harness). In some examples, the buckle 101 can include a belt buckle style grip that is placed in the middle of two pieces of thick foam neoprene. The buckle 101 has a releasing mechanism that unlocks the buckle for easy detachment of the apparatus 100 from the person wearing it.

As shown, in some examples, one part of the buckle 101 is on the right side, and the other one is on the left side. And, when attached, the two sides create an upside-down triangle in some embodiments. And, as shown, the two sides of the buckle 101 and the harness 102 are similar upside-down triangles. In some embodiments, the upside-down triangular shape of the harness 102 can enhance the benefits provided by the apparatus 100 to the core or the glutes and abdominal muscles of the person wearing the apparatus properly. The shape of the harness 102, and in some cases, the shape of the buckle too, distributes the weight of the apparatus 100 and the bag 103 to exercise or stabilize the core or the glutes and abdominal muscles of the person wearing the apparatus properly.

In some embodiments, as shown in the drawings, an apparatus includes a frontal abdominal harness (e.g., see harness 102) attached to a bag positioned in the rear of a person upon the person's gluteus maximus (e.g., see bag 103). The harness secures on the person's abdominal muscles activating the abdominal muscles. In some examples, the harness includes a neoprene body as well as a connecting hook, release button, four latches, and four straps. When the four straps are adjusted, they can stabilize the bag attached to the harness at the rear of the person. The bag can include fabric, pockets, four of its own straps attached to corresponding straps of the harness via four intra-strap connectors, and four strap reinforcements for each one of the straps of the bag. The bag, when worn properly, can activate or at least stimulate the glutes. Also, the bag folds upon usage allowing long objects to be placed within the space provided between the fold. The straps of the bag and the straps of the harness are combinable into four greater straps. Each of the greater straps ultimately connects the bag to the frontal harness with two straps on each side of the harness or the bag. The straps can be at least two millimeters thick in some embodiments. The straps include one pair of straps that is configured to be placed along or above the hips of a person, and the other pair of straps is configured to be placed along or below the hips of the person. The apparatus that includes the harness and the bag also includes housing on any of the aforesaid parts or the straps to house extra strap length after the strap has been adjusted to fit the person.

In the foregoing specification, embodiments of the disclosure have been described with reference to specific example embodiments thereof. It will be evident that various modifications can be made thereto without departing from the broader spirit and scope of embodiments of the disclosure as set forth in the following claims. The specification and drawings are, accordingly, to be regarded in an illustrative sense rather than a restrictive sense.

What is claimed is:

1. An apparatus, comprising:

a bag;

a harness; and two pairs of straps configured to connect the bag to the harness when the apparatus is worn by a person, wherein, when worn by the person, the harness rests in front of the person near or on the abdominal muscles of the person and the bag rests in back of the person near or on the glutes of the person, and wherein, when worn by the person and the harness rests in front of the person near or on the abdominal muscles of the person and the bag rests in back of the person near or on the glutes of the person, one pair of the straps is configured to wrap at the top or just above the hips and the other pair of the straps is configured to wrap at the bottom or just below the hips, wherein the harness comprises two main parts and the two main parts are connectable via a buckle, wherein the two main parts of the harness are two symmetrical halves of the harness, wherein the buckle comprises two main parts and the two main parts of the buckle are two symmetrical halves of the buckle, and wherein the harness and the buckle are upside-down triangular shapes.

2. The apparatus of claim 1, wherein the bag comprises a zipper at a top opening of the bag and at least one back pocket.

3. The apparatus of claim 1, wherein the bag comprises two pockets in the rear of the bag.

4. The apparatus of claim 3, wherein the two pockets are arranged to appear to be back pockets of a pair of pants.

5. The apparatus of claim 1, wherein the buckle has the same upside-down triangular shape as the harness in that the ratio of the lengths of the three sides of its triangle are the same as the ratio of the lengths of the three sides of the triangle of the harness.

6. The apparatus of claim 1, wherein each strap of the two pairs of straps comprises two-sub-straps connectable to each other by an intra-strap connector.

7. An apparatus for strengthening or stabilizing the glutes, the abdominal muscles, or the core of a person wearing the apparatus, comprising:

a bag;

a harness; and two pairs of straps configured to connect the bag to the harness when the apparatus is worn by the person, wherein, when worn by the person, the harness rests in front of the person near or on the abdominal muscles of the person and the bag rests in back of the person near or on the glutes of the person, and wherein, when worn by the person and the harness rests in front of the person near or on the abdominal muscles of the person and the bag rests in back of the person near or on the glutes of the person, one pair of the straps is configured to wrap at the top or just above the hips and the other pair of the straps is configured to wrap at the bottom or just below the hips, wherein the harness comprises two main parts and the two main parts are connectable via a buckle, wherein the two main parts of the harness are two symmetrical halves of the harness, wherein the buckle comprises two main parts and the two main parts of the buckle are two symmetrical halves of the buckle, and wherein the harness and the buckle are upside-down triangular shapes.

8. The apparatus of claim 7, wherein the bag comprises a zipper, and wherein each strap of the two pairs of straps comprises two-sub-straps connectable to each other by an intra-strap connector.

9. The apparatus of claim 7, wherein the bag comprises two pockets in the rear of the bag.

10. The apparatus of claim 9, wherein the two pocks are arranged to appear to be back pockets of a pair of pants.

11. The apparatus of claim 7, wherein the buckle has the same upside-down triangular shape as the harness in that the ratio of the lengths of the three sides of its triangle are the same as the ratio of the lengths of the three sides of the triangle of the harness.

12. An apparatus, comprising:

a bag;

a harness;

a buckle; and two pairs of straps configured to connect the bag to the harness when the apparatus is worn by a person in order to strengthen or stabilize the glutes, the abdominal muscles, or the core of the person, wherein, when worn by the person, the harness rests in front of the person near or on the abdominal muscles of the person and the bag rests in back of the person near or on the glutes of the person, and wherein, when worn by the person and the harness rests in front of the person near or on the abdominal muscles of the person and the bag rests in back of the person near or on the glutes of the person, one pair of the straps is configured to wrap at the top or just above the hips and the other pair of the straps is configured to wrap at the bottom or just below the hips, and wherein the harness and the buckle are upside-down triangular shapes.

13. The apparatus of claim 12, wherein the bag comprises a zipper at a top opening of the bag and at least one back pocket.

14. The apparatus of claim 13, wherein the bag comprises two pockets in the rear of the bag.

15. The apparatus of claim 14, wherein the two pockets are arranged to appear to be back pockets of a pair of pants.

16. The apparatus of claim 12, wherein the harness comprises two main parts and the two main parts are connectable via the buckle.

17. The apparatus of claim 16, wherein the two main parts of the harness are two symmetrical halves of the harness.

18. The apparatus of claim 17, wherein the buckle comprises two main parts and the two main parts of the buckle are two symmetrical halves of the buckle.

19. The apparatus of claim 18, wherein the buckle has the same upside-down triangular shape as the harness in that the ratio of the lengths of the three sides of its triangle are the same as the ratio of the lengths of the three sides of the triangle of the harness.

20. The apparatus of claim 12, wherein each strap of the two pairs of straps comprises two-sub-straps connectable to each other by an intra-strap connector.

* * * * *